US009528352B2

(12) United States Patent
Reinhardt et al.

(10) Patent No.: US 9,528,352 B2
(45) Date of Patent: Dec. 27, 2016

(54) EXTRUSION-RESISTANT SEALS FOR EXPANDABLE TUBULAR ASSEMBLY

(75) Inventors: Paul Andrew Reinhardt, Houston, TX (US); Rocky A. Turley, Houston, TX (US); Brent J. Lirette, Cypress, TX (US); Huy V. Le, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 757 days.

(21) Appl. No.: 13/029,022

(22) Filed: Feb. 16, 2011

(65) Prior Publication Data

US 2012/0205872 A1 Aug. 16, 2012

(51) Int. Cl.
*E21B 33/12* (2006.01)
*E21B 43/10* (2006.01)

(52) U.S. Cl.
CPC ..... *E21B 43/103* (2013.01); *E21B 33/1208* (2013.01); *Y10T 29/4987* (2015.01)

(58) Field of Classification Search
USPC ..... 277/336, 339, 323, 314, 609; 166/387, 166/207, 242, 380
See application file for complete search history.

(56) References Cited

U.S. PATENT DOCUMENTS

| | | | | |
|---|---|---|---|---|
| 2,125,665 | A | 8/1938 | Bettis | |
| 2,652,894 | A | 9/1953 | Brown et al. | |
| 3,147,016 | A | 9/1964 | Traufler | |
| 3,215,208 | A | 11/1965 | Tamplen | |
| 3,227,462 | A | 1/1966 | Tamplen | |
| 3,278,192 | A | 10/1966 | Tamplen | |
| 3,374,838 | A * | 3/1968 | Current | 166/123 |
| 3,631,926 | A * | 1/1972 | Young | 166/134 |
| 3,784,214 | A | 1/1974 | Tamplen | |
| 4,482,086 | A | 11/1984 | Wagner et al. | |
| 4,588,029 | A | 5/1986 | Blizzard | |
| 4,809,989 | A * | 3/1989 | Kernal | 277/337 |

(Continued)

FOREIGN PATENT DOCUMENTS

SU 1 367 586 C1 11/1996

OTHER PUBLICATIONS

International Search Report and Written Opinion; International Application No. PCT/US2012/025531; mailed Jan. 8, 2013.

(Continued)

*Primary Examiner* — Kristina Fulton
*Assistant Examiner* — Eugene G Byrd
(74) *Attorney, Agent, or Firm* — Patterson & Sheridan, LLP

(57) ABSTRACT

The present invention generally relates to extrusion-resistant seals for an expandable tubular assembly. In one aspect, a seal assembly for creating a seal between a first tubular and a second tubular is provided. The seal assembly includes an annular member attached to the first tubular, the annular member having a groove formed on an outer surface of the annular member. The seal assembly further includes a seal member disposed in the groove, the seal member having one or more anti-extrusion bands. The seal member is configured to be expandable radially outward into contact with an inner wall of the second tubular by the application of an outwardly directed force supplied to an inner surface of the annular member. Additionally, the seal assembly includes a gap defined between the seal member and a side of the groove. In another aspect, a method of creating a seal between a first tubular and a second tubular is provided.

24 Claims, 10 Drawing Sheets

(56) References Cited

U.S. PATENT DOCUMENTS

| | | | | |
|---|---|---|---|---|
| 5,052,483 | A | 10/1991 | Hudson | |
| 5,076,356 | A | 12/1991 | Reimert | |
| 5,311,938 | A | 5/1994 | Hendrickson et al. | |
| 5,333,692 | A | 8/1994 | Baugh et al. | |
| 5,355,961 | A | 10/1994 | Gariepy et al. | |
| 5,433,269 | A | 7/1995 | Hendrickson | |
| 5,462,121 | A | 10/1995 | Schmuck et al. | |
| 5,467,822 | A | 11/1995 | Zwart | |
| 5,511,620 | A | 4/1996 | Baugh et al. | |
| 5,603,511 | A * | 2/1997 | Keyser et al. | 277/337 |
| 5,685,369 | A | 11/1997 | Ellis et al. | |
| 5,857,520 | A * | 1/1999 | Mullen et al. | 166/196 |
| 6,123,148 | A * | 9/2000 | Oneal | 166/118 |
| 6,142,227 | A * | 11/2000 | Hiorth et al. | 166/123 |
| 6,409,175 | B1 | 6/2002 | Evans et al. | |
| 6,425,444 | B1 | 7/2002 | Metcalfe et al. | |
| 6,446,717 | B1 * | 9/2002 | White et al. | 166/187 |
| 6,666,276 | B1 | 12/2003 | Yokley et al. | |
| 6,691,789 | B2 | 2/2004 | Jackson et al. | |
| 6,705,615 | B2 | 3/2004 | Milberger et al. | |
| 6,763,893 | B2 * | 7/2004 | Braddick | 166/382 |
| 6,769,491 | B2 * | 8/2004 | Zimmerman et al. | 166/387 |
| 6,772,844 | B2 * | 8/2004 | Lloyd et al. | 166/387 |
| 6,789,622 | B1 | 9/2004 | Ducasse et al. | |
| 6,814,143 | B2 | 11/2004 | Braddick | |
| 6,902,008 | B2 * | 6/2005 | Hirth et al. | 166/387 |
| 6,962,206 | B2 | 11/2005 | Hirth et al. | |
| 7,036,581 | B2 | 5/2006 | Trahan | |
| 7,165,622 | B2 | 1/2007 | Hirth et al. | |
| 7,172,029 | B2 * | 2/2007 | Hirth et al. | 166/387 |
| 7,213,814 | B2 * | 5/2007 | Hurlbert et al. | 277/630 |
| 7,225,880 | B2 | 6/2007 | Braddick | |
| 7,234,533 | B2 | 6/2007 | Gambier | |
| 7,252,142 | B2 | 8/2007 | Brezinski et al. | |
| 7,322,422 | B2 | 1/2008 | Patel | |
| 7,360,592 | B2 * | 4/2008 | McMahan | 166/207 |
| 7,367,404 | B2 | 5/2008 | Simpson et al. | |
| 7,370,708 | B2 | 5/2008 | Simpson et al. | |
| 7,380,592 | B2 * | 6/2008 | Atkins et al. | 166/202 |
| 7,387,170 | B2 | 6/2008 | Doane et al. | |
| 7,407,165 | B1 * | 8/2008 | Chisnell | 277/603 |
| 7,441,606 | B2 | 10/2008 | Maguire | |
| 7,469,750 | B2 | 12/2008 | Carr | |
| 7,493,945 | B2 * | 2/2009 | Doane et al. | 166/179 |
| 7,665,532 | B2 * | 2/2010 | Cook et al. | 166/380 |
| 7,703,542 | B2 | 4/2010 | O'Connor et al. | |
| 7,740,248 | B2 * | 6/2010 | Keene et al. | 277/603 |
| 7,748,467 | B2 | 7/2010 | Doane | |
| 7,766,088 | B2 | 8/2010 | Saucier et al. | |
| 7,775,290 | B2 * | 8/2010 | Brisco et al. | 166/384 |
| 7,779,927 | B2 | 8/2010 | Turley et al. | |
| 7,784,797 | B2 * | 8/2010 | Baugh et al. | 277/607 |
| 7,921,921 | B2 * | 4/2011 | Bishop et al. | 166/373 |
| 8,066,065 | B2 * | 11/2011 | Buckner | 166/118 |
| 8,109,340 | B2 * | 2/2012 | Doane et al. | 166/387 |
| 8,459,347 | B2 * | 6/2013 | Stout | 166/138 |
| 2002/0088616 | A1 | 7/2002 | Swor et al. | |
| 2004/0060706 | A1 * | 4/2004 | Stephenson | 166/380 |
| 2004/0123983 | A1 | 7/2004 | Cook et al. | |
| 2005/0172472 | A1 * | 8/2005 | Verger et al. | 29/507 |
| 2005/0173110 | A1 * | 8/2005 | Trahan | 166/217 |
| 2006/0186602 | A1 | 8/2006 | Martin et al. | |
| 2006/0272827 | A1 | 12/2006 | Adam et al. | |
| 2007/0151725 | A1 | 7/2007 | Cook et al. | |
| 2009/0205843 | A1 | 8/2009 | Gandikota et al. | |
| 2010/0089591 | A1 | 4/2010 | Thomson et al. | |
| 2011/0037230 | A1 * | 2/2011 | O'Connor et al. | 277/336 |
| 2013/0292138 | A1 * | 11/2013 | Givens et al. | 166/387 |

OTHER PUBLICATIONS

International Search Report and Written Opinion; International Application No. PCT/US2012/025508; mailed Jan. 18, 2013.

International Search Report and Written Opinion; International Application No. PCT/US2012/025533; mailed Jan. 18, 2013.

Non-Final Office Action dated Nov. 20, 2013 for U.S. Appl. No. 13/398,831.

Non-Final Office Action dated Jul. 23,2014 for U.S. Appl. No. 13/398,833.

Non-Final Office Action dated Feb. 11, 2015 for U.S. Appl. No. 13/398,831.

Non-Final Office Action dated Feb. 27, 2015 for U.S. Appl. No. 13/398,829.

Australian Patent Examination Report dated Mar. 13, 2015, for Australian Application No. 2012217607.

* cited by examiner

EXTRUSION-RESISTANT SEALS FOR EXPANDABLE TUBULAR ASSEMBLY

BACKGROUND OF THE INVENTION

Field of the Invention

Embodiments of the present invention generally relate to a downhole expansion assembly. More particularly, embodiments of the present invention relate to seals for the downhole expansion assembly.

Description of the Related Art

In the oilfield industry, downhole tools are employed in the wellbore at different stages of operation of the well. For example, an expandable liner hanger may be employed during the formation stage of the well. After a first string of casing is set in the wellbore, the well is drilled a designated depth and a liner assembly is run into the well to a depth whereby the upper portion of the liner assembly is overlapping a lower portion of the first string of casing. The liner assembly is fixed in the wellbore by expanding a liner hanger into the surrounding casing and then cementing the liner assembly in the well. The liner hanger includes seal members disposed on an outer surface of the liner hanger. The seal members are configured to create a seal with the surrounding casing upon expansion of the liner hanger.

In another example, a packer may be employed during the production stage of the well. The packer typically includes a packer assembly with seal members. The packer may seal an annulus formed between production tubing disposed within casing of the wellbore. Alternatively, some packers seal an annulus between the outside of a tubular and an unlined borehole. Routine uses of packers include the protection of casing from pressure, both well and stimulation pressures, and protection of the wellbore casing from corrosive fluids. Packers may also be used to hold kill fluids or treating fluids in the casing annulus.

Both the liner hanger and the packer include seal members that are configured to create a seal with the surrounding casing or an unlined borehole. Each seal member is typically disposed in a groove (or gland) formed in an expandable tubular assembly of the liner hanger or packer. However, the seal member may extrude out of the groove during expansion of the expandable tubular assembly due to the characteristics of the seal member. Further, the seal member may extrude out of the groove after expansion of the expandable tubular assembly due to pressure differentials applied to the seal member. Therefore, there is a need for extrusion-resistant seals for use with an expandable tubular assembly.

SUMMARY OF THE INVENTION

The present invention generally relates to extrusion-resistant seals for an expandable tubular assembly. In one aspect, a seal assembly for creating a seal between a first tubular and a second tubular is provided. The seal assembly includes an annular member attached to the first tubular, the annular member having a groove formed on an outer surface of the annular member. The seal assembly further includes a seal member disposed in the groove, the seal member having one or more anti-extrusion bands. The seal member is configured to be expandable radially outward into contact with an inner wall of the second tubular by the application of an outwardly directed force supplied to an inner surface of the annular member. Additionally, the seal assembly includes a gap defined between the seal member and a side of the groove.

In another aspect, a method of creating a seal between a first tubular and a second tubular is provided. The method includes the step of positioning the first tubular within the second tubular, the first tubular having a annular member with a groove, wherein a seal member with at least one anti-extrusion band is disposed within the groove and wherein a gap is formed between a side of the seal member and a side of the groove. The method further includes the step of expanding the annular member radially outward, which causes the first anti-extrusion band and the second anti-extrusion band to move toward a first interface area and a second interface area between the annular member and the second tubular. The method also includes the step of urging the seal member into contact with an inner wall of the second tubular to create the seal between the first tubular and the second tubular.

In yet another aspect, a seal assembly for creating a seal between a first tubular and a second tubular is provided. The seal assembly includes an annular member attached to the first tubular, the annular member having a groove formed on an outer surface thereof. The seal assembly further includes a seal member disposed in the groove of the annular member such that a side of the seal member is spaced apart from a side of the groove, the seal member having one or more anti-extrusion bands, wherein the one or more anti-extrusion bands move toward an interface area between the annular member and the second tubular upon expansion of the annular member.

In a further aspect, a hanger assembly is provided. The hanger assembly includes an expandable annular member having an outer surface and an inner surface. The hanger assembly further includes a seal member disposed in a groove formed in the outer surface of the expandable annular member, the seal member having one or more anti-extrusion spring bands embedded within the seal member. The hanger assembly also includes an expander sleeve having a tapered outer surface and an inner bore. The expander sleeve is movable between a first position in which the expander sleeve is disposed outside of the expandable annular member and a second position in which the expander sleeve is disposed inside of the expandable annular member. The expander sleeve is configured to radially expand the expandable annular member as the expander sleeve moves from the first position to the second position.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The present invention generally relates to extrusion-resistant seals for a downhole tool. The extrusion-resistant seals will be described herein in relation to a liner hanger in FIGS. 1-10, a packer in FIGS. 11-15 and a hanger assembly in FIGS. 16-17. It is to be understood, however, that the extrusion-resistant seals may also be used with other downhole tools without departing from principles of the present invention. To better understand the novelty of the extrusion-resistant seals of the present invention and the methods of use thereof, reference is hereafter made to the accompanying drawings.

Figure 1:
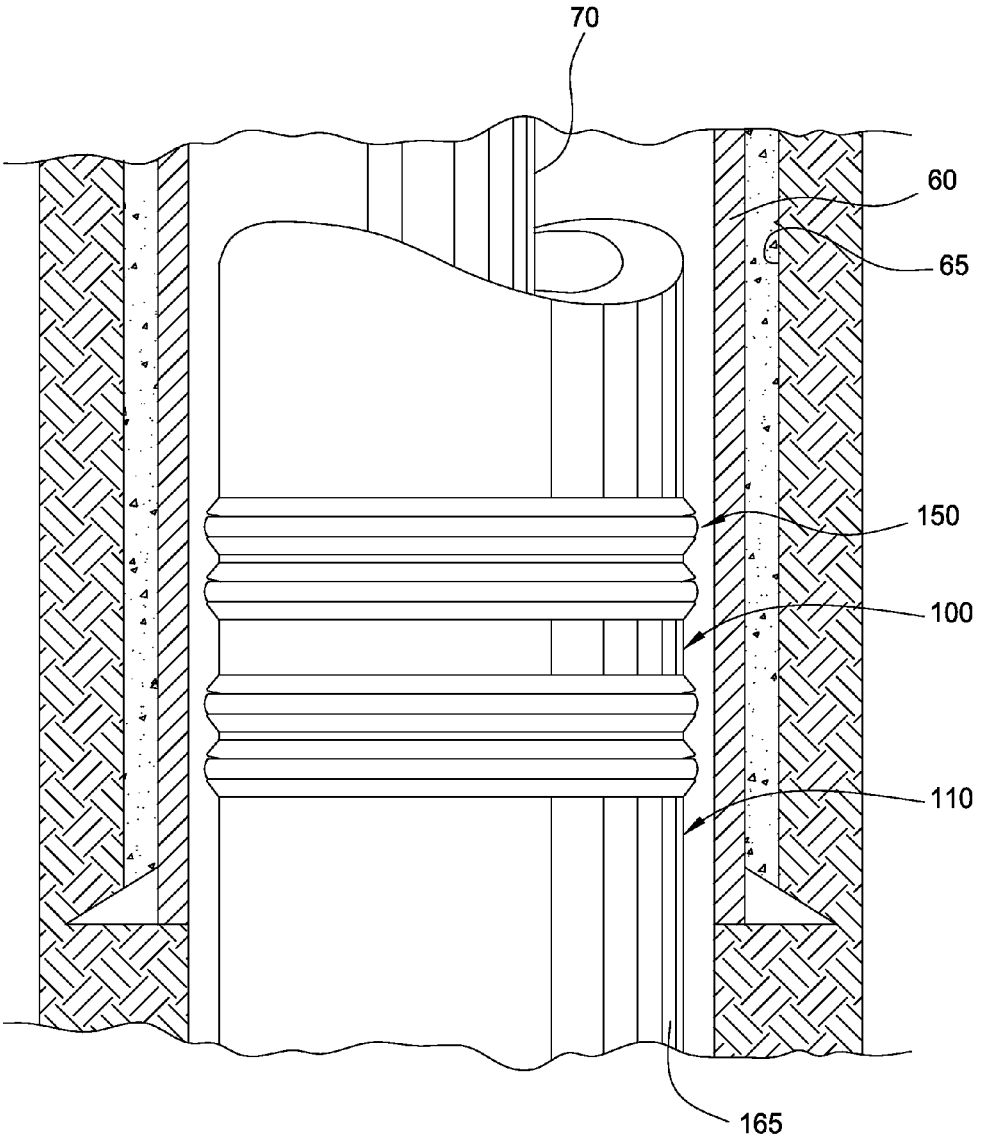
FIG. 1 illustrates a view of an expandable hanger in a run-in (unset) position.

FIG. 1 illustrates a view of an expandable hanger 100 in a run-in (unset) position. At the stage of completion shown in FIG. 1, a wellbore 65 has been lined with a string of casing 60. Thereafter, a subsequent liner assembly 110 is positioned proximate the lower end of the casing 60. Typically, the liner assembly 110 is lowered into the wellbore 65 by a running tool disposed at the lower end of a work string 70.

The liner assembly 110 includes a tubular 165 and the expandable hanger 100 of this present invention. The hanger 100 is an annular member that is used to attach or hang the tubular 165 from an internal wall of the casing 60. The expandable hanger 100 includes a plurality of seal assemblies 150 disposed on the outer surface of the hanger 100. The plurality of seal assemblies 150 are circumferentially spaced around the hanger 100 to create a seal between liner assembly 110 and the casing 60 upon expansion of the hanger 100. Although the hanger 100 in FIG. 1 shows four seal assemblies 150, any number of seal assemblies 150 may be attached to liner assembly 110 without departing from principles of the present invention.

Figure 2:
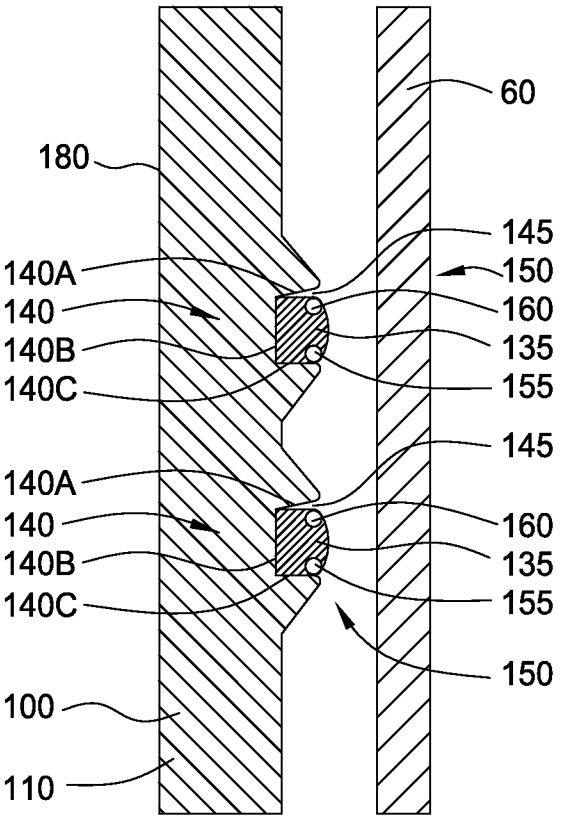
FIG. 2 illustrates a view of a seal assembly of the expandable hanger.

FIG. 2 illustrates an enlarged view of the seal assemblies 150 in the run-in position. For clarity, the wellbore 65 is not shown in FIGS. 2-6. Each seal assembly 150 includes a seal ring 135 disposed in a gland 140. The gland 140 includes a first side 140A, a second side 140B and a third side 140C. In the embodiment shown in FIG. 2, a bonding material, such as glue (or other attachment means), may be used on sides 140B, 140C during the fabrication stage of the seal assembly 150 to attach the seal ring 135 in the gland 140. Bonding the seal ring 135 in the gland 140 is useful to prevent the seal ring 135 from becoming unstable and swab off when the hanger 100 is positioned in the casing 60 and prior to expansion of the hanger 100. In one embodiment, the side 140A has an angle $\alpha$ (see FIG. 5) of approximately 100 degrees prior to expansion, and side 140A has an angle $\beta$ (see FIG. 6) between about 94 degrees and about 98 degrees after expansion of the seal assembly 150.

Figure 5:
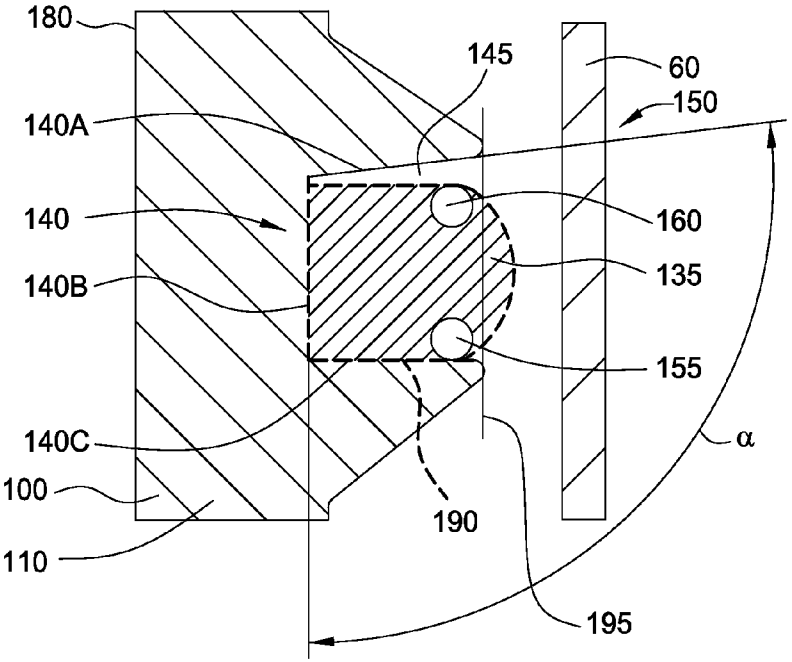
FIG. 5 illustrates an enlarged view of the seal assembly prior to expansion.

As shown in FIG. 5, a volume gap 145 is created between the seal ring 135 and the side 140A of the gland 140. Generally, the volume gap 145 is used to substantially prevent distortion of the seal ring 135 upon expansion of the hanger 100. The volume gap 145 is a free-space (empty space, clearance or void) between a portion of the seal ring 135 and a portion of the gland 140 prior to expansion of the hanger 100. In other words, during the fabrication process of the hanger, the volume gap 145 is created by positioning the seal ring 135 within the gland 140 such that the seal ring 135 is spaced apart from at least one side of the gland 140. Even though the volume gap 145 in FIG. 5 is created by having a side of the gland 140 at an angle, the volume gap 145 may be created in any configuration (see FIGS. 7-10, for example) without departing from principles of the present invention. Additionally, the size of the volume gap 145 may vary depending on the configuration of the gland 140. In one embodiment, the gland 140 has 3-5% more volume due to the volume gap 145 than a standard gland without a volume gap.

Referring back to FIG. 2, the seal ring 135 includes one or more anti-extrusion bands, such as a first seal band 155 (first anti-extrusion band) and a second seal band 160 (second anti-extrusion band). As shown, the seal bands 155, 160 are embedded in the seal ring 135 in an upper corner of each side of the seal ring 135. In one embodiment, the seal bands 155, 160 are disposed on an outer circumference of the seal ring 135. In another embodiment, the seal bands 155, 160 are springs. The seal bands 155, 160 may be used to limit the extrusion of the seal ring 135 during expansion of the seal assembly 150. The seal bands 155, 160 may also be used to limit the extrusion of applied differential pressure after expansion of the seal assembly 150.

Figure 3:
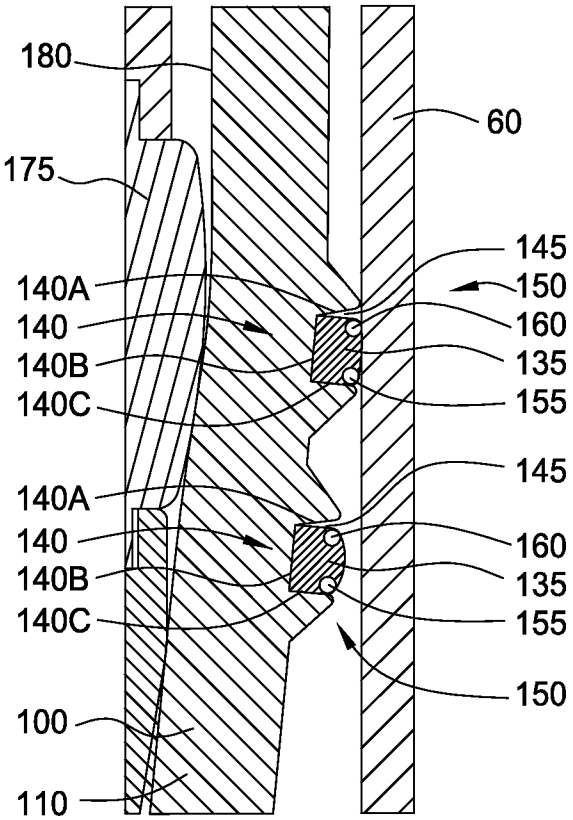
FIG. 3 illustrates a view of the seal assembly during expansion of the expandable hanger.
Figure 4B:
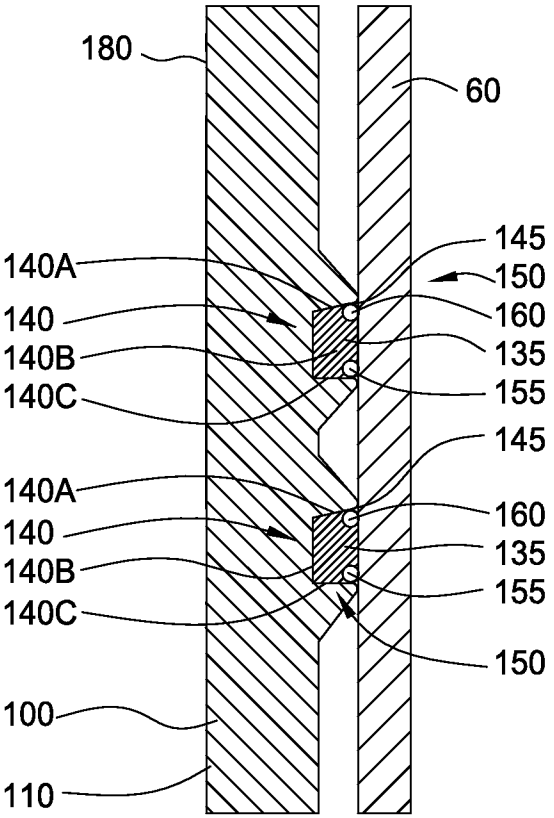
FIGS. 4A and 4B illustrate a view of the seal assembly after expansion of the expandable hanger.
Figure 4A:
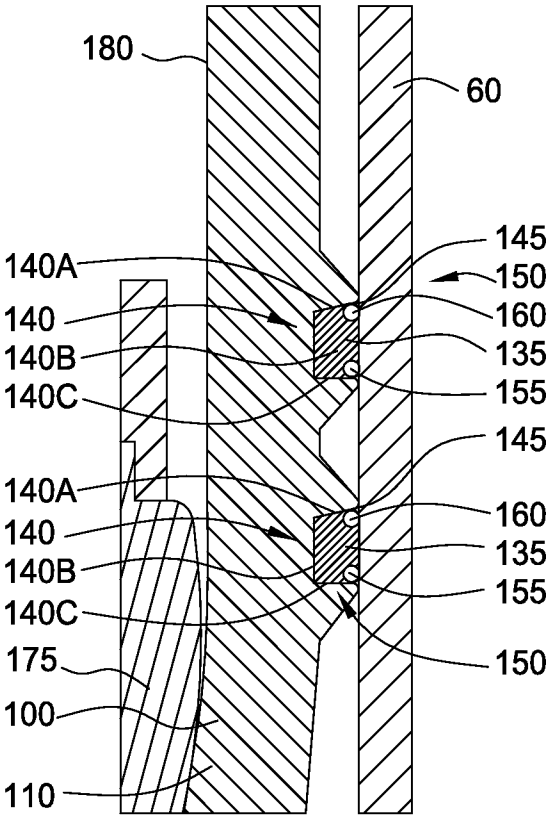

FIG. 3 illustrates a view of the seal assemblies 150 during expansion and FIGS. 4A and 4B illustrate the seal assemblies 150 after expansion. As shown, an axially movable expander tool 175 contacts an inner surface 180 of the liner assembly 110. Expander tools are well known in the art and are generally used to radially enlarge an expandable tubular by urging the expander tool 175 axially through the tubular, thereby swaging the tubular wall radially outward as the larger diameter tool is forced through the smaller-diameter tubular member. The expander tool 175 may be attached to a threaded mandrel which is rotated to move the expander tool 175 axially through the hanger 100 and expand the hanger 100 outward in contact with the casing 60. It is to be understood, however, that other means may be employed to urge the expander tool 175 through the hanger 100 such as hydraulics or any other means known in the art. Furthermore, the expander tool 175 may be disposed in the hanger 100 in any orientation, such as in a downward orientation as shown for a top down expansion or in an upward orientation for a bottom up expansion. Additionally, a rotary expandable tool (not shown) may be employed. The rotary expandable tool moves between a first smaller diameter and a second larger diameter, thereby allowing for both a top down expansion and a bottom up expansion depending on the directional axial movement of the rotary expandable tool.

As shown in FIG. 3, the expander tool 175 has expanded a portion of the hanger 100 toward the casing 60. During expansion of the hanger 100, the seal ring 135 moves into contact with the casing 60 to create a seal between the hanger 100 and the casing 60. As the seal ring 135 contacts the casing 60, the seal ring 135 changes configuration and occupies a portion of the volume gap 145. In the embodiment shown, the volume gap 145 is located on the side of the seal assembly 150 which is the first portion to be expanded by the expander tool 175. The location of the volume gap 145 in the seal assembly 150 allows the seal ring 135 to change position (or reconfigure) within the gland 140 during the expansion operation. Additionally, the volume of the volume gap 145 may change during the expansion operation. As shown in FIG. 4B, the expander tool 175 is removed from the hanger 100 after the hanger 100 is expanded into contact with the casing 60.

Figure 6:
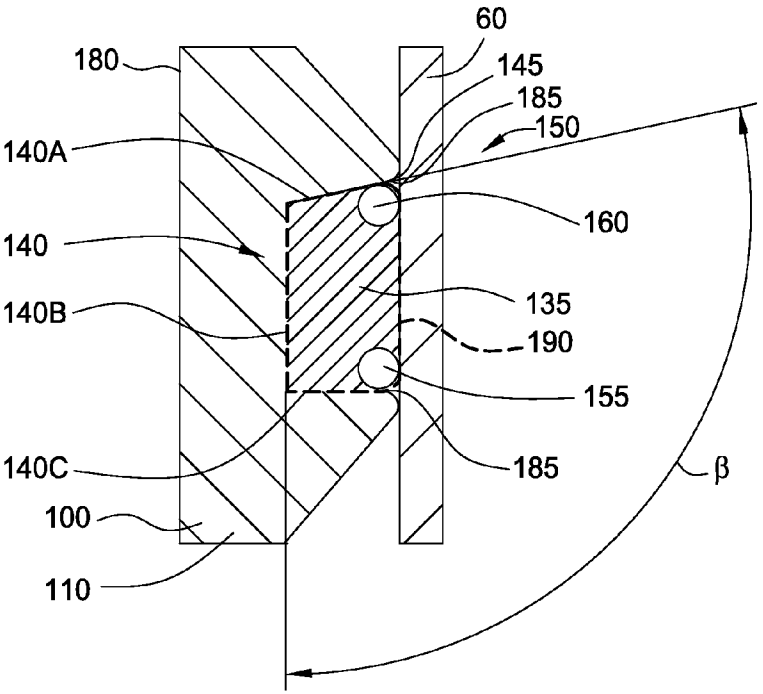
FIG. 6 illustrates an enlarged view of the seal assembly after expansion.

The seal ring 135 changes configuration during the expansion operation. As shown in FIG. 5, the seal ring 135 has a volume which is represented by reference number 190. Prior to expansion, a portion of the volume 190 of the seal ring 135 is positioned within the gland 140 and another portion of the volume 190 of the seal ring 135 extends outside of the gland 140 (beyond line 195). After expansion, the volume 190 of the seal ring 135 is repositioned such that the seal ring 135 moves into the volume gap 145 as shown in FIG. 6. In other words, the volume 190 of the seal ring 135 is substantially the same prior to expansion and after expansion. However, the volume of the seal ring 135 within the gland 140 increases after the expansion operation because the portion of the volume 190 of the seal ring 135 that was outside of the gland 140 (beyond line 195) has moved within the gland 140 (compare FIGS. 5 and 6). Thus, the volume 190 of the seal ring 135 is substantially within the gland 140 after the expansion operation. In an alternative embodiment, the seal ring 135 does not extend outside of the gland 140 (beyond line 195) prior to expansion. The volume 190 of the seal ring 135 is repositioned during the expansion operation such that the seal ring 135 moves into the volume gap 145. The volume 190 of the seal ring 135 is substantially the same prior to expansion and after expansion. In this manner, the seal ring 135 changes configuration during the expansion operation and occupies (or closes) the volume gap 145.

The volume of the gland 140 and/or the volume gap 145 may decrease as the seal assembly 150 is expanded radially outward during the expansion operation. As set forth herein, the angle $\alpha$ (FIG. 5) decreases to the angle $\beta$ (FIG. 6), which causes the size of the volume gap 145 to decrease. The height of the gland 140 may also become smaller, which causes the volume of the gland 140 to decrease. As such, the combination of the change in configuration of the seal ring 135 and the change of configuration of the volume of the gland 140 (and/or the volume gap 145) allows the seal ring 135 to create a seal with the casing 60. In one embodiment, the volume of the gland 140 (including the volume gap 145) after the expansion operation may be substantially the same as the volume 190 of the seal ring 135. In another embodiment, the volume of the gland 140 (including the volume gap 145) after the expansion operation may be equal to the volume 190 of the seal ring 135 or may be greater than the volume 190 of the seal ring 135.

As shown in FIG. 6, the seal bands 155, 160 in the seal ring 135 are urged toward an interface 185 between the seal assembly 150 and the casing 60 during the expansion operation. The volume gap 145 permits the seal ring 135 to move within the gland 140 and position the seal bands 155, 160 at a location proximate the interface 185. In this position, the seal bands 155, 160 substantially prevent the extrusion of the seal ring 135 past the interface 185. In other words, the seal bands 155, 160 expand radially outward with the hanger 100 and block the elastomeric material of the seal ring 135 from flowing through the interface 185 between the seal assembly 150 and the casing 60. In one embodiment, the seal bands 155, 160 are springs, such as toroidal coil springs, which expand radially outward due to the expansion of the hanger 100. As the spring expands radially outward, the coils of spring act as a barrier to the flow of the elastomeric material of the seal ring 135. In this manner, the seal bands 155, 160 in the seal ring 135 act as an anti-extrusion device or an extrusion barrier.

There are several benefits of the extrusion barrier created by the seal bands 155, 160. One benefit of the extrusion barrier would be that the outer surface of the seal ring 135 in contact with the casing 60 is limited to a region between the seal bands 155, 160, which allows for a high-pressure seal to be created between the seal assembly 150 and the casing 60. In one embodiment, the seal assembly 150 may create a high-pressure seal in the range of 12,000 to 14,000 psi. A further benefit of the extrusion barrier would be that the seal assembly 150 is capable of creating a seal with a surrounding casing that may have a range of inner diameters due to API tolerances. Another benefit would be that the extrusion barrier created by the seal bands 155, 160 may prevent erosion of the seal ring 135 after the hanger 100 has been expanded. The erosion of the seal ring 135 could eventually lead to a malfunction of the seal assembly 150. A further benefit is that the seal bands 155, 160 act as an extrusion barrier after expansion of the expandable hanger 100. More specifically, the extrusion barrier created by the seal bands 155, 160 may prevent extrusion of the seal ring 135 when the gap between the expandable hanger 100 and the casing 60 is increased due to downhole pressure. In other words, the seal bands 155, 160 bridge the gap, and the net extrusion gap between coils of the seal bands 155, 160 grows considerably less as compared to an annular gap that is formed when a seal ring does not include the seal bands. For instance, the annular gap (without seal bands) may be on the order of 0.030" radial as compared to the net extrusion gap between coils of the seal bands 155, 160 which may be on the order of 0.001/0.003".

Figure 7:
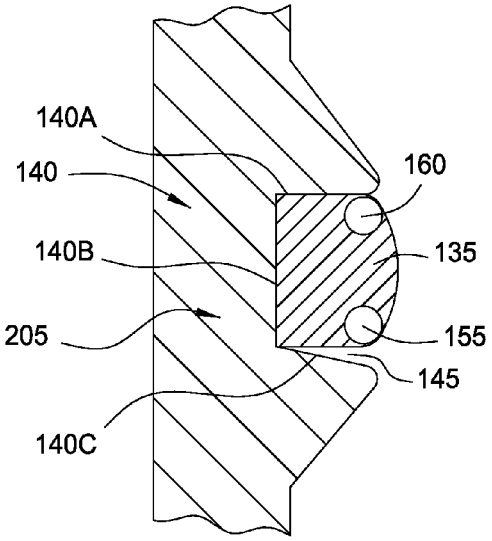
FIGS. 7-10 illustrate views of different embodiments of the seal assembly.

FIGS. 7-10 illustrate views of different embodiments of the seal assembly. For convenience, the components in the seal assembly in FIGS. 7-10 that are similar to the components in the seal assembly 150 will be labeled with the same number indicator. FIG. 7 illustrates a view of a seal assembly 205 that includes the volume gap 145 on a lower portion of the seal assembly 205. As shown, the volume gap 145 is between the side 140C and the seal ring 135. In this embodiment, a bonding material, such as glue, may be applied to sides 140A, 140B during the fabrication stage of the seal assembly 205 to attach the seal ring 135 in the gland 140. Similar to other embodiments, the seal ring 135 will be reconfigured and occupy at least a portion of the volume gap 145 upon expansion of the seal assembly 205.

Figure 8:
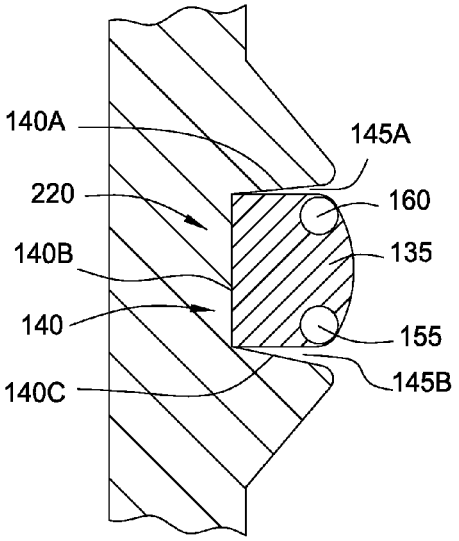

FIG. 8 illustrates a view of a seal assembly 220 that includes the volume gap 145 on a lower portion and an upper portion of the seal assembly 220. As shown, a first volume gap 145A is between the side 140A and the seal ring 135 and a second volume gap 145B is between the side 140C and the seal ring 135. The first volume gap 145A and the second volume gap 145B may be equal or may be different. In this embodiment, the bonding material may be applied to the side 140B during the fabrication stage of the seal assembly 220 to attach the seal ring 135 in the gland 140. Similar to other embodiments, the seal ring 135 will be reconfigured and occupy at least a portion of the first volume gap 145A and at least a portion of the second volume gap 145B upon expansion of the seal assembly 220.

Figure 9:
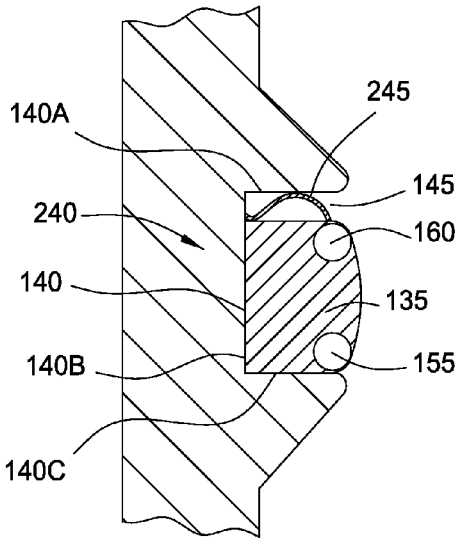

FIG. 9 illustrates a view of a seal assembly 240 that includes the volume gap 145 with a biasing member 245. As shown, the side 140A of the gland 140 is perpendicular to the side 140B. The biasing member 245, such as a spring washer or a crush ring, is disposed in the volume gap 145 between the side 140A and the seal ring 135. The biasing member 245 may be used to maintain the position of the seal ring 135 in the gland 140. In addition to seal band 160, the biasing member 245 may also act as an extrusion barrier upon expansion of the seal assembly 240. During the expansion operation, the seal ring 135 will be reconfigured in the gland 140 and compress the biasing member 245. Additionally, in this embodiment, the bonding material may be used on sides 140B, 140C during the fabrication stage of the seal assembly 240 to attach the seal ring 135 in the gland 140.

Figure 10:
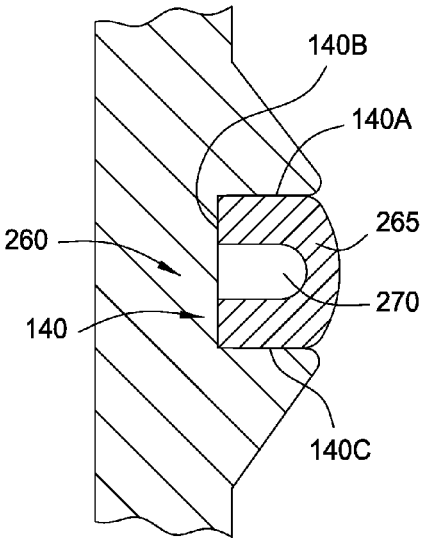

FIG. 10 illustrates a view of a seal assembly 260 that includes a volume gap 270 in a portion of a seal ring 265. In this embodiment, the bonding material may be used on sides 140A, 140B, 140C during the fabrication stage of the seal assembly 260 to attach the seal ring 265 in the gland 140. Similar to other embodiments, the seal ring 265 will be reconfigured upon expansion of the seal assembly 260. However, in this embodiment, the volume gap 270 in the portion of the seal ring 265 will be close or decrease in size when the seal ring 265 is urged into contact with the surrounding casing. In another embodiment, the seal ring 265 may include seal bands (not shown) embedded in the seal ring 265 similar to seal bands 155, 160. In a further embodiment, an equalization vent (not shown) may be formed in the seal ring 265 to provide communication between the volume gap 270 and an external portion of the seal ring 265. The equalization vent may be used to prevent the collapse of the seal ring 265 due to exposure of hydrostatic pressure.

Figure 11:
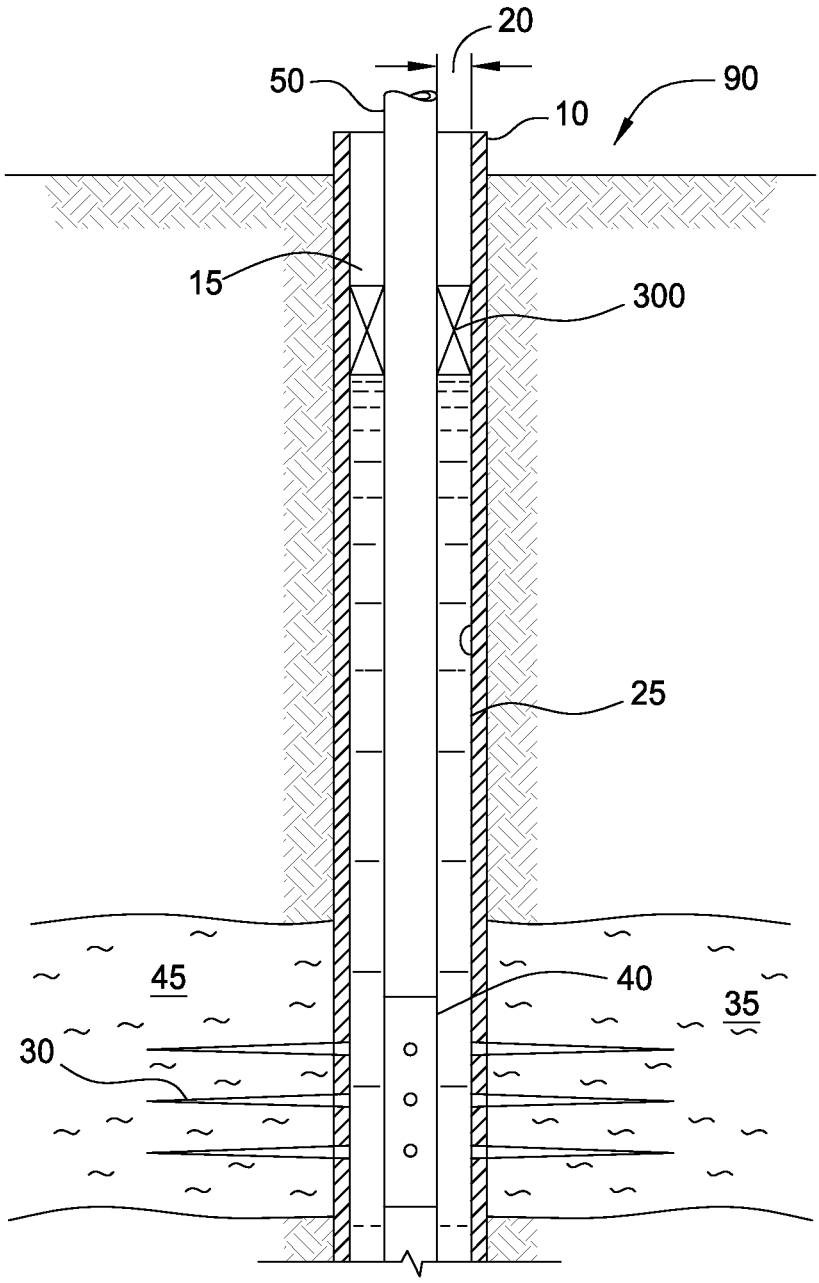
FIG. 11 illustrates a view of a downhole tool in a well.

FIG. 11 illustrates a view of a typical subterranean hydrocarbon well 90 that defines a vertical wellbore 25. The well 90 has multiple hydrocarbon-bearing formations, such as oil-bearing formation 45 and/or gas-bearing formations (not shown). After the wellbore 25 is formed and lined with casing 10, a tubing string 50 is run into an opening 15 formed by the casing 10 to provide a pathway for hydrocarbons to the surface of the well 90. Hydrocarbons may be recovered by forming perforations 30 in the formations 45 to allow hydrocarbons to enter the casing opening 15. In the illustrative embodiment, the perforations 30 are formed by operating a perforation gun 40, which is a component of the tubing string 50. The perforating gun 40 is used to perforate the casing 10 to allow the hydrocarbons trapped in the formations 45 to flow to the surface of the well 90.

The tubing string 50 also carries a downhole tool 300, such as a packer, a bridge plug or any other downhole tool used to seal a desired location in a wellbore. Although generically shown as a singular element, the downhole tool 300 may be an assembly of components. Generally, the downhole tool 300 may be operated by hydraulic or mechanical means and is used to form a seal at a desired location in the wellbore 25. The downhole tool 300 may seal, for example, an annular space 20 formed between a production tubing 50 and the wellbore casing 106. Alternatively, the downhole tool 300 may seal an annular space between the outside of a tubular and an unlined wellbore. Common uses of the downhole tool 300 include protection of the casing 10 from pressure and corrosive fluids; isolation of casing leaks, squeezed perforations, or multiple producing intervals; and holding of treating fluids, heavy fluids or kill fluids. However, these uses for the downhole tool 300 are merely illustrative, and application of the downhole tool 300 is not limited to only these uses. The downhole tool 300 may also be used with a conventional liner hanger (not shown) in a liner assembly. Typically, the downhole tool 300 would be positioned in the liner assembly proximate the conventional liner hanger. In one embodiment, the downhole tool assembly is positioned above the conventional liner hanger. After the conventional liner hanger is set inside the wellbore casing, a cementation operation may be done to secure the liner within the wellbore. Thereafter, the downhole tool 300 may be activated to seal an annular space formed between liner assembly and the wellbore casing.

Figure 12:
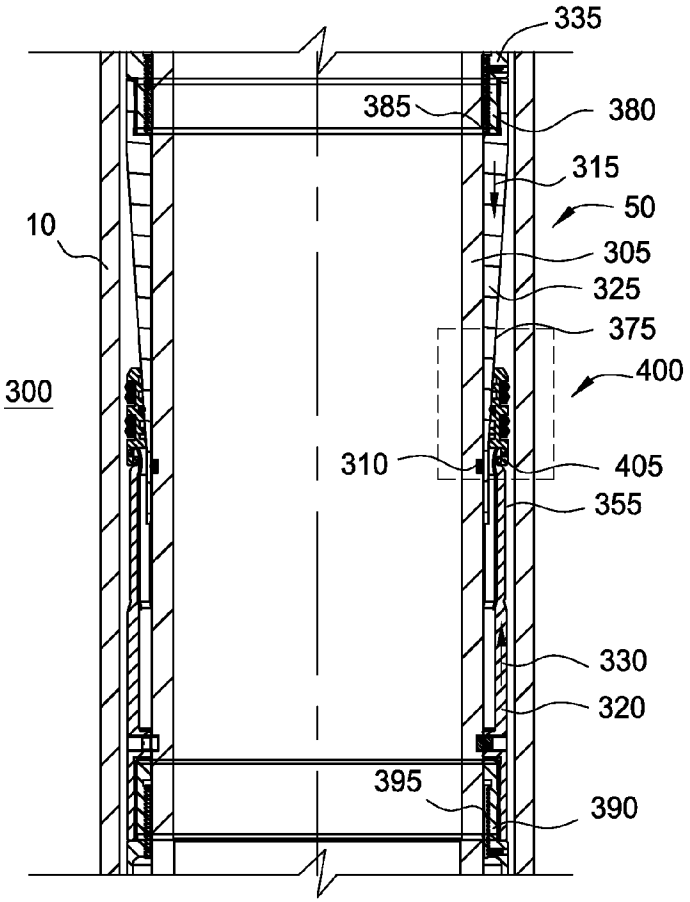
FIG. 12 illustrates a view of the downhole tool in a run-in position.

FIG. 12 illustrates the downhole tool 300 in a run-in (unset) position. As shown in FIG. 12, the tubing string 50 includes a mandrel 305 which defines an inner diameter of the depicted portion of the tubing string 50. An actuator sleeve 335 is slidably disposed about at least a portion of the mandrel 305. The mandrel 305 and the actuator sleeve 335 define a sealed interface by the provision of an O-ring (not shown) carried on an outer diameter of the mandrel 305. A terminal end of the actuator sleeve 335 is shouldered against a wedge member 325. The wedge member 325 is generally cylindrical and slidably disposed about the mandrel 305. An O-ring 310 seal is disposed between the mandrel 305 and the wedge member 325 to form a sealed interface therebetween. The seal 310 is carried on the inner surface of the wedge member 325; however, the seal 310 may also be carried on the outer surface of the mandrel 305. In one embodiment, the seal 310 includes seal bands (i.e., anti-extrusion bands) in a similar manner as sealing element 450A-B. Further, a volume gap may be defined between the seal 310 and a portion of the wedge member 325 in a similar manner as volume gap 470A-B.

The downhole tool 300 includes a locking mechanism which allows the wedge member 325 to travel in one direction and prevents travel in the opposite direction. In one embodiment, the locking mechanism is implemented as a ratchet ring 380 disposed on a ratchet surface 385 of the mandrel 305. The ratchet ring 380 is recessed into, and carried by, the wedge member 325. In this case, the interface of the ratchet ring 380 and the ratchet surface 385 allows the wedge member 325 to travel only in the direction of the arrow 315.

A portion of the wedge member 325 forms an outer tapered surface 375. In operation, the tapered surface 375 forms an inclined glide surface for a packing element 400. Accordingly, the wedge member 325 is shown disposed between the mandrel 305 and packing element 400, where the packing element 400 is disposed on the tapered surface 375. In the depicted run-in position, the packing element 400 is located at a tip of the wedge member 325, the tip defining a relatively smaller outer diameter with respect to the other end of the tapered surface 375.

The packing element 400 is held in place by a retaining sleeve 320. The packing element 400 may be coupled to the retaining sleeve 320 by a variety of locking interfaces. In one embodiment, the retaining sleeve 320 includes a plurality of collet fingers 355. The terminal ends of the collet fingers 355 are interlocked with an annular lip 405 of the packing element 400. The collet fingers 355 may be biased in a radial direction. For example, it is contemplated that the collet fingers 355 have outward radial bias urging the collet fingers 355 into a flared or straighter position. However, in this case the collet fingers 355 do not provide a sufficient force to cause expansion of the packing element 400.

The downhole tool 300 includes a self-adjusting locking mechanism which allows the retaining sleeve 320 to travel in one direction and prevents travel in the opposite direction. The locking mechanism is implemented as a ratchet ring 390 disposed on a ratchet surface 395 of the mandrel 305. The ratchet ring 390 is recessed into, and carried by, the retaining sleeve 320. In this case, the interface of the ratchet ring 390 and the ratchet surface 395 allows the retaining sleeve 320 to travel only in the direction of the arrow 330, relative to the mandrel 305. As will be described in more detail below, this self-adjusting locking mechanism ensures that a sufficient seal is maintained by the packing element 400 despite counter-forces acting to subvert the integrity of the seal.

Figure 14:
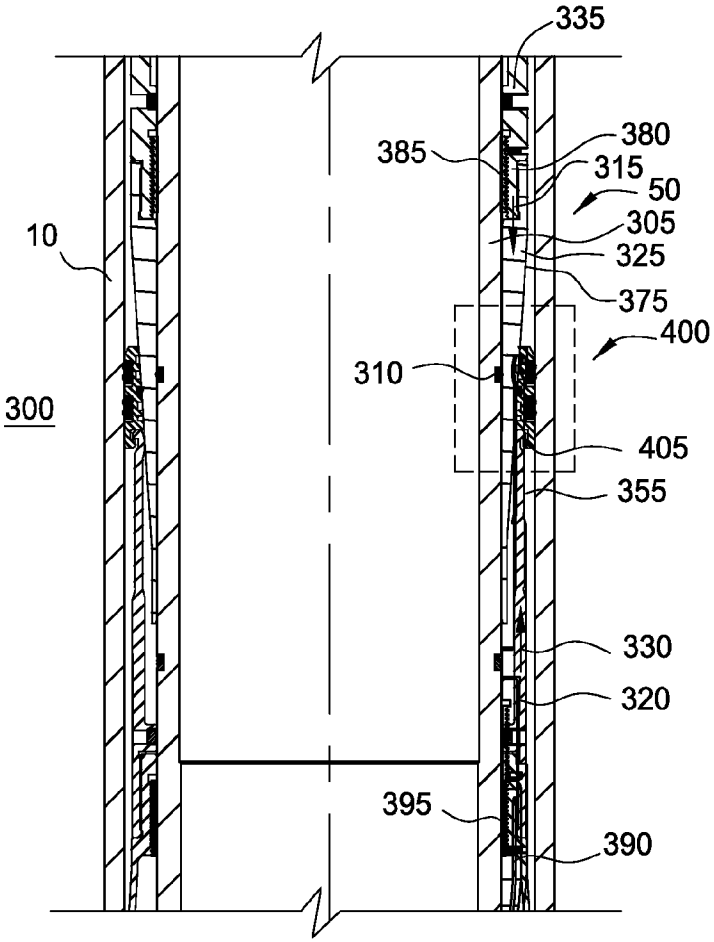
FIG. 14 illustrates a view of the downhole tool in an expanded and operating position.

In operation, the downhole tool 300 is run into a wellbore in the run-in position shown in FIG. 12. To set the downhole tool 300, the actuator sleeve 335 is driven axially in the direction of the arrow 315. The axial movement of the actuator sleeve 335 may be caused by, for example, applied mechanical force from the weight of a tubing string or hydraulic pressure acting on a piston. The actuator sleeve 335, in turn, engages the wedge member 325 and drives the wedge member 325 axially along the outer surface of the mandrel 305. The ratchet ring 380 and the ratchet surface 385 ensure that the wedge member 325 travels only in the direction of the arrow 315. With continuing travel over the mandrel 305, the wedge member 325 is driven underneath the packing element 400. The packing element 400 is prevented from moving with respect to the wedge member 325 by the provision of the ratchet ring 390 and the ratchet surface 395. As a result, the packing element 400 is forced to slide over the tapered surface 375. The positive inclination of the tapered surface 375 urges the packing element 400 into a diametrically expanded position. The set position of the packer 300 is shown in FIG. 14. In the set position, the packing element 400 rests at an upper end of the tapered surface 375 and is urged into contact with the casing 10 to form a fluid-tight seal which is formed in part by a metal-to-elastomer seal and a metal-to-metal contact. More generally, the metal may be any non-elastomer.

Figure 15:
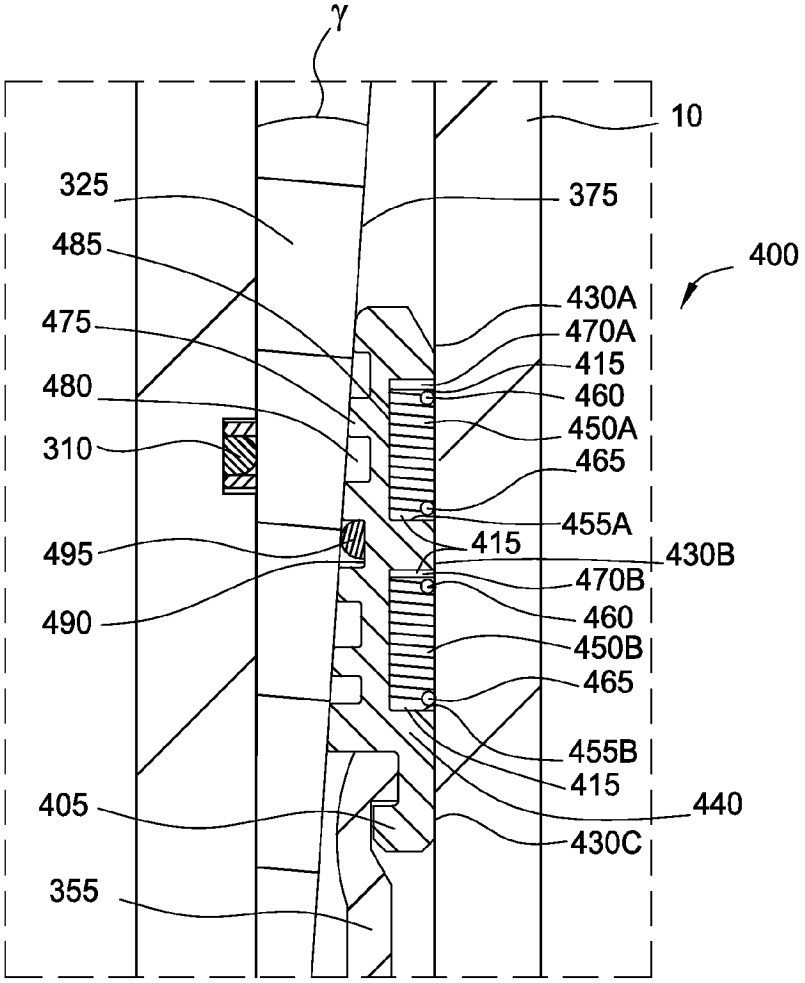
FIG. 15 illustrates an enlarged view of the packing element in the downhole tool.

In the set position, the collet fingers 355 are flared radially outwardly but remain interlocked with the lip 405 formed on the packing element 400. This coupling ties the position of the retaining sleeve 320 and ratchet ring 390 to the axial position of packing element 400. This allows the packing element 400 to move up the wedge member 325 in response to increased pressure from below, maintaining its tight interface with the casing inner diameter, but prevents relative movement of the packing element 400 in the opposite direction (shown by the arrow 315). The pressure from below the downhole tool 300 may act to diminish the integrity of the seal formed by the packing element 400 since the interface of the packing element 400 with the casing 10 and wedge member 325 will loosen due to pressure swelling the casing 10 and likewise acting to collapse the wedge member 325 from under the packing element 400. One embodiment of the downhole tool 300 counteracts such an undesirable effect by the provision of the self-adjusting locking mechanism implemented by the ratchet ring 390 and ratchet surface 395. In particular, the retaining sleeve 320 is permitted to travel up the mandrel 305 in the direction of the arrow 330 in response to a motivating force acting on the packing element 400, as shown in FIG. 15. However, the locking mechanism prevents the retaining sleeve 320 from traveling in the opposite direction (i.e., in the direction of arrow 315), thereby ensuring that the seal does not move with respect to the casing 10 when pressure is acting from above, thus reducing wear on the packing element 400.

Figure 13:
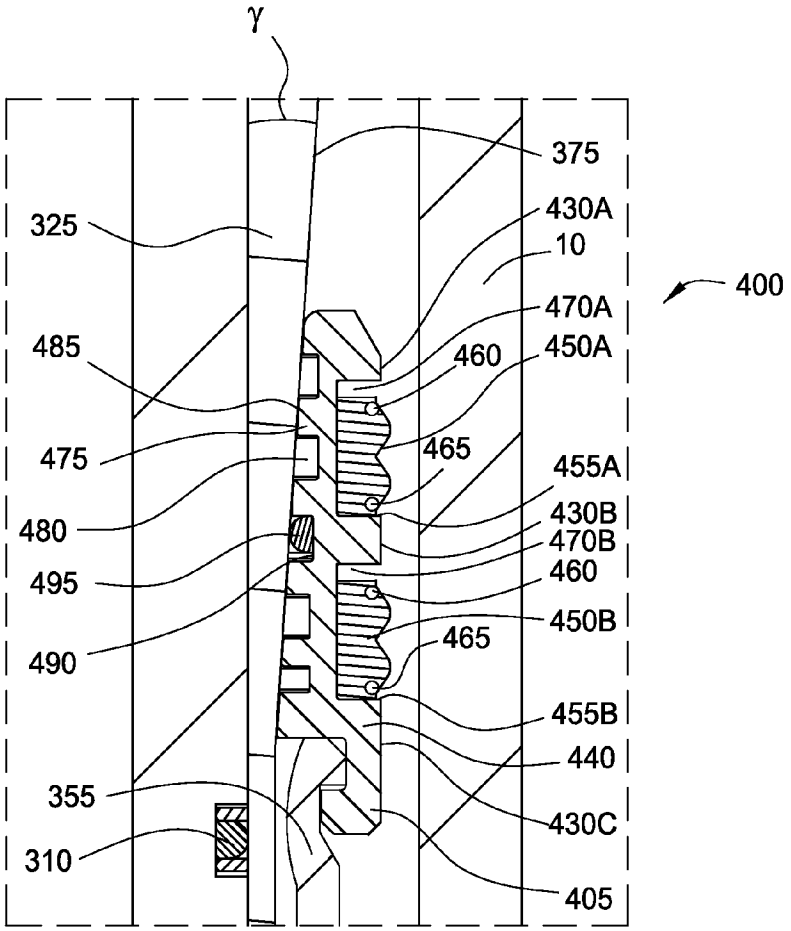
FIG. 13 illustrates an enlarged view of a packing element in the downhole tool.

FIG. 13 illustrates an enlarged view of the packing element 400 in the unset position. As such, the packing element 400 rests on the diametrically smaller end of the tapered surface 375. The packing element 400 includes a tubular body 440 which is an annular member. The tubular body 440 includes a substantially smooth outer surface at its outer diameter, and defining a shaped inner diameter. In this context, a person skilled in the art will recognize that a desired smoothness of the outer surface is determined according to the particular environment and circumstances in which the packing element 400 is set. For example, the expected pressures to be withstood by the resulting seal formed by the packing element 400 will affect the smoothness of the outer surface. In one embodiment, the tubular body 440 may include a portion of the outer surface that includes knurling or a rough surface area.

To form a seal with respect to the casing 10, the packing element 400 includes one or more sealing elements 450A-B. The sealing elements 450A-B may be elastomer bands preferably secured in grooves 455A-B formed in the tubular body 440. For example, the sealing elements 450A-B may be bonded to the grooves 455A-B by a bonding material during the fabrication stage of the packing element 400. Each groove 455A-B includes a volume gap 470A-B. As shown in FIG. 13, the volume gap 470A-B is located on a lower portion of the groove 455A-B. In other embodiments, the volume gap 470A-B may be located at different positions and in different configurations in the groove 455A-B (see volume gap in FIGS. 5-10, for example). Generally, the volume gap 470A-B is used to substantially prevent distortion of the sealing element 450A-B upon expansion of the packing element 400. The size of the volume gap 470A-B may vary depending on the configuration of the groove 455A-B. In one embodiment, the groove 455A-B has 3-5% more volume due to the volume gap 470A-B than a groove without a volume gap.

Each sealing element 450A-B includes a first seal band 460 and a second seal band 465. The seal bands 460, 465 are embedded in the sealing element 450A-B. In one embodiment, the seal bands 460, 465 are springs. The seal bands 460, 465 are used to limit the extrusion of the sealing element 450A-B upon expansion of the packing element 400.

The portions of the outer surface between the sealing elements 450A-B form non-elastomer sealing surfaces 430A-C. The non-elastomer sealing surfaces 430A-C may include knurling or a rough surface which allows the non-elastomer sealing surfaces 430A-C to seal and act as an anchor upon expansion of the packing element 400. The number and size of the sealing elements 450A-B define the surface area of the non-elastomer sealing surfaces 430A-C. It is to be noted that any number of sealing elements 450A-B and non-elastomer sealing surfaces 430A-C may be provided. The packing element 400 shown includes two sealing elements 450A-B and defining three non-elastomer sealing surfaces 430A-C. In general, a relatively narrow width of each non-elastomer sealing surface 430A-C is preferred in order to achieve a sufficient contact force between the surfaces and the casing 10.

The shaped inner diameter of the tubular body 440 is defined by a plurality of ribs 475 separated by a plurality of cutouts 480 (e.g., voids). The cutouts 480 allow a degree of deformation of the tubular body 440 when the packing element 400 is placed into a sealed position. Further, the cutouts 480 aid in reducing the amount of setting force required to expand the packing element 400 into the sealed position. In other words, by removing material (e.g., cutouts 480) of the tubular body 440, the force required to expand the packing element 400 is reduced. In one embodiment, the volume of the cutouts 480 (voids) is between 25-40% of the volume of the tubular body 440. The ribs 475 are annular members integrally formed as part of the tubular body 440. Each rib 475 forms an actuator-contact surface 485 at the inner diameter of the tubular body 340, where the rib 475 is disposed on the tapered surface 375. In an illustrative embodiment, the tapered surface 375 has an angle γ between about 2 degrees and about 6 degrees. Accordingly, the shaped inner diameter defined by the actuator-contact surfaces 485 may have a substantially similar taper angle.

The tubular body 440 further includes an O-ring seal 495 in cutout 490. The seal 495 is configured to form a fluid-tight seal with respect to the outer tapered surface 375 of the wedge member 325. In one embodiment, the seal 495 includes seal bands (i.e., anti-extrusion bands) in a similar manner as sealing element 450A-B. Further, a volume gap may be defined between the seal 495 and a portion of the cutout 490 in a similar manner as volume gap 470A-B. It is noted that in another embodiment, the cutouts 480 may also, or alternatively, carry seals at their respective inner diameters.

In FIG. 15, the packing element 400 is shown in the sealed (set) position, corresponding to FIG. 14. During expansion of the packing element 400, the sealing element 450A-B moves into contact with the casing 10 to create a seal between the packing element 400 and the casing 10. As the sealing element 450A-B contacts the casing 10, the sealing element 450A-B changes configuration and occupies a portion of the volume gap 470A-B. In the embodiment shown, the volume gap 470A-B is located on the side of the packing element 400, which is the last portion to be expanded by the wedge member 325. The location of the volume gap 470A-B in the packing element 400 allows the sealing element 450A-B to change position (or reconfigure) within the groove 455A-B during the expansion operation. Additionally, the volume of the volume gap 470A-B may change during the expansion operation. In one embodiment, the volume of the volume gap 470A-B may be reduced by 5-15% during the expansion operation.

During the expansion operation, the seal bands 460, 465 in the sealing element 450A-B are urged toward an interface 415 between the packing element 400 and the casing 10, as shown in FIG. 6. The volume gap 470A-B permits the sealing element 450A-B to move within the groove 455A-B and position the seal bands 460, 465 at a location proximate the interface 415. In comparing the volume gap 470A-B prior to expansion (FIG. 13) and after expansion (FIG. 15), a small volume gap remains after the expansion operation. It is to be noted that the small volume gap is optional. In other words, there may not be a small volume gap (see volume gap 470A-B on FIG. 15) after the expansion operation.

The seal bands 460, 465 are configured to substantially prevent the extrusion of the sealing element 450A-B past the interface 415. In other words, the seal bands 460, 465 expand radially outward with the packing element 400 and block the elastomeric material of the sealing element 450A-B from flowing through the interface 415 between the packing element 400 and the casing 10. In one embodiment, the seal bands 460, 465 are springs, such as toroidal coil springs, which expand radially outward due to the expansion of the packing element 400. As the spring expands radially outward during the expansion operation, the coils of spring act as a barrier to the flow of the elastomeric material of the sealing element 450A-B. After the expansion operation, the seal bands 460, 465 may prevent extrusion of the sealing element 450A-B when a gap between the packing element 400 and the casing 10 is increased due to downhole pressure. In other words, the seal bands 460, 465 bridge the gap between the packing element 400 and the casing 10 and prevent extrusion of the sealing element 450A-B. In this manner, the seal bands 460, 465 in the sealing element 450A-B act as an anti-extrusion device or an extrusion barrier during the expansion operation and after the expansion operation.

There are several benefits of the extrusion barrier created by the seal bands 460, 465. One benefit of the extrusion barrier would be that the outer surface of the sealing element 450A-B in contact with the casing 10 is limited to a region between the seal bands 460, 465, which allows for a high pressure seal to be created between the packing element 400 and the casing 10. In one embodiment, the packing element 400 may create a high-pressure seal in the range of 12,000 to 15,000 psi. A further benefit of the extrusion barrier would be that the packing element 400 is capable of creating a seal with a surrounding casing that may have a range of inner diameters due to API tolerances. Another benefit would be that the extrusion barrier created by the seal bands 460, 465 may prevent erosion of the sealing element 450A-B after the packing element 400 has been expanded. The erosion of the sealing element 450A-B could eventually lead to a malfunction of the packing element 400.

The packing element 400 rests at the diametrically enlarged end of the tapered surface 375 and is sandwiched between the wedge member 325 and the casing 10. The dimensions of the downhole tool 300 are preferably such that the packing element 400 is fully engaged with the casing 10, before the tubular body 440 reaches the end of the tapered surface 375. Note that in the sealed position, the sealing elements 450A-B and the non-elastomer sealing surfaces 430A-C have been expanded into contact with the casing 10.

As such, it is clear that the tubular body 440 has undergone a degree of deformation. The process of deformation may occur, at least in part, as the packing element 400 slides up the tapered surface 375, prior to making contact with the inner diameter of the casing 10. Additionally or alternatively, deformation may occur as a result of contact with the inner diameter of the casing 106. In any case, the process of deformation causes the sealing elements 450A-B and the non-elastomer sealing surfaces 430A-C to contact the inner diameter of the casing 10 in the sealed position. In addition, the non-elastomeric backup seals prevent extrusion of the sealing elements 450A-B.

Figure 16:
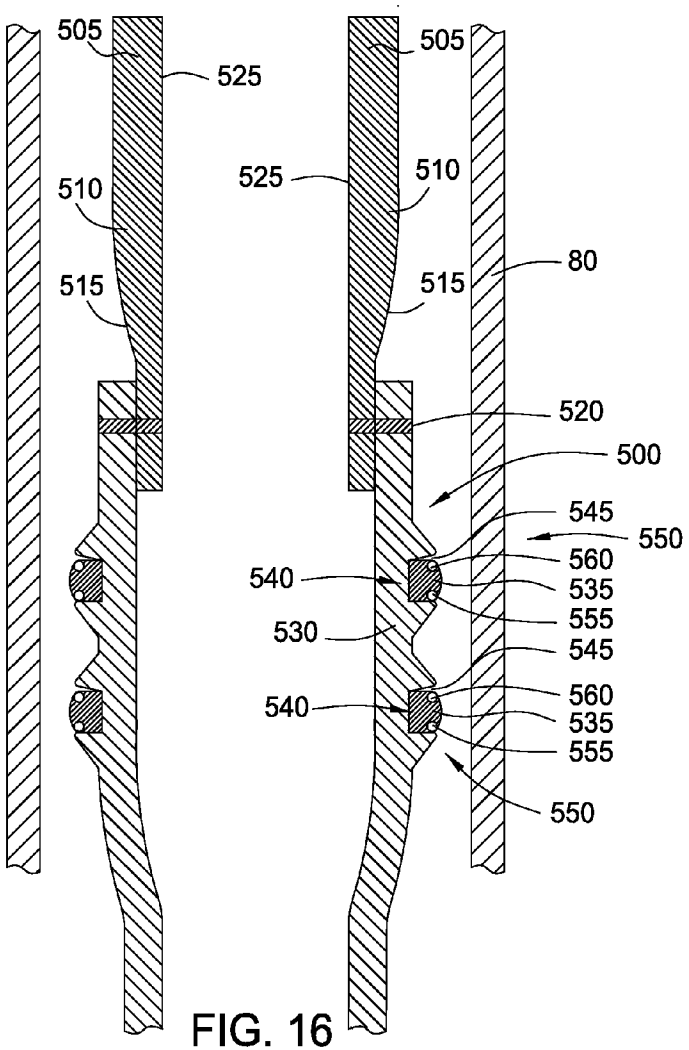
FIG. 16 illustrates a view of a hanger assembly in an unset position.

FIG. 16 illustrates a hanger assembly 500 in an unset position. At the stage of completion shown in FIG. 16, a wellbore has been lined with a string of casing 80. Thereafter, the hanger assembly 500 is positioned within the casing 80. The hanger assembly 500 includes a hanger 530, which is an annular member. The hanger assembly further includes an expander sleeve 510. Typically, the hanger assembly 500 is lowered into the wellbore by a running tool disposed at the lower end of a work string (not shown).

The hanger assembly 500 includes the hanger 530 of this present invention. The hanger 530 may be used to attach or hang liners from an internal wall of the casing 80. The hanger 530 may also be used as a patch to seal an annular space formed between hanger assembly 500 and the wellbore casing 80 or an annular space between hanger assembly 500 and an unlined wellbore. The hanger 530 optionally includes grip members, such as tungsten carbide inserts or slips. The grip members may be disposed on an outer surface of the hanger 530. The grip members may be used to grip an inner surface of the casing 80 upon expansion of the hanger 530.

As shown in FIG. 16, the hanger 530 includes a plurality of seal assemblies 550 disposed on the outer surface of a tubular body of the hanger 530. The plurality of seal assemblies 550 are circumferentially spaced around the hanger 530 to create a seal between hanger assembly 500 and the casing 80. Each seal assembly 550 includes a seal ring 535 disposed in a gland 540. A bonding material, such as glue (or other attachment means), may be used on selective sides of the gland 540 to attach the seal ring 535 in the gland 540. Bonding the seal ring 535 in the gland 540 is useful to prevent the seal ring 535 from becoming unstable and swab off when the hanger 530 is positioned in the casing 80 and prior to expansion of the hanger 530. Bonding the seal ring 535 in the gland 540 is also useful to resist circulation flow swab off as installation of liners typically require fluid displacements prior to sealing and anchoring of the hanger assembly 500.

The side of the gland 540 creates a volume gap 545 between the seal ring 535 and the gland 540. As set forth herein, the volume gap 545 is generally used to minimize distortion of the seal ring 535 upon expansion of the hanger 530. The volume gap 545 may be created in any configuration (see FIGS. 7-10, for example) without departing from principles of the present invention. Additionally, the size of the volume gap 545 may vary depending on the configuration of the gland 540. The seal ring 535 includes a first seal band 555 and a second seal band 560. The seal bands 555, 560 are embedded in opposite sides of the seal ring 535. The seal bands 555, 560 are used to limit the extrusion of the seal ring 535 during and after expansion of the seal assembly 550.

The hanger assembly 500 includes the expander sleeve 510 which is used to expand the hanger 530. In one embodiment, the expander sleeve 510 is attached to the hanger 530 by an optional releasable connection member 520, such as a shear pin. The expander sleeve 510 includes a tapered outer surface 515 and a bore 525. The expander sleeve 510 further includes an end portion 505 that is configured to interact with an actuator member (not shown). The expander sleeve 510 optionally includes a self-adjusting locking mechanism (not shown) which allows the expander sleeve 510 to travel in one direction and prevents travel in the opposite direction.

To set the hanger assembly 500, the actuator member is driven axially in a direction toward the hanger 530. The axial movement of the actuator member may be caused by, for example, applied mechanical force from the weight of a tubing string or hydraulic pressure acting on a piston. The actuator member, in turn, engages the end portion 505 of the expander sleeve 510 in order to move the expander sleeve 510 axially toward the hanger 530. At a predetermined force, the optional releasable connection member 520 is disengaged, which allows the expander sleeve 510 to move relative to the hanger 530. The hanger 530 is prevented from moving with respect to the wedge expander sleeve 510. As the tapered outer surface 515 of expander sleeve 510 engages the inner surface of the hanger 530, the hanger 530 is moved into a diametrically expanded position.

Figure 17:
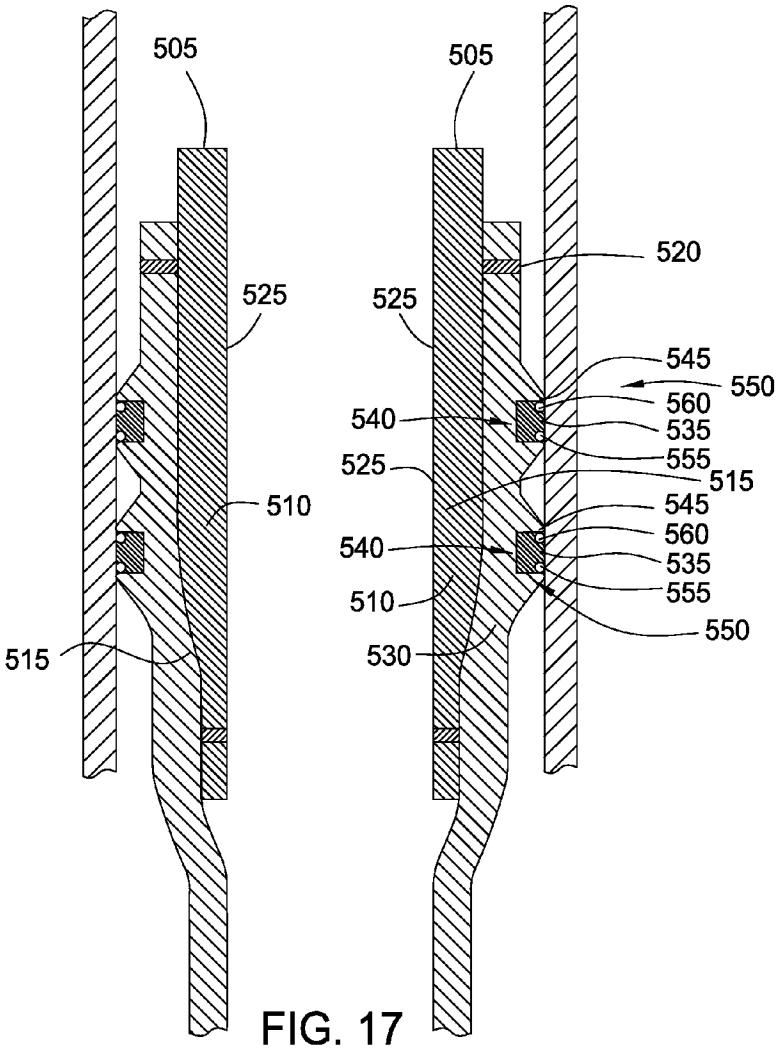
FIG. 17 illustrates a view of the hanger assembly in a set position.

The set position of the hanger assembly 500 is shown in FIG. 17. In the set position, the expander sleeve 510 is positioned inside the hanger 530. In other words, the expander sleeve 510 is not removed from the hanger 530. This arrangement may allow the expander sleeve 510 to apply a force on the hanger 530 after the expansion operation. The bore 525 of the expander sleeve 510 permits other wellbore tools to pass through the hanger assembly 500 prior to expansion of the hanger 530 and after expansion of the hanger 530. In comparing the hanger assembly 500 in the unset position (FIG. 16) and the hanger assembly 500 in the set position (FIG. 17), it is noted that the expander sleeve 510 is disposed substantially outside of the hanger 530 in the unset position and the expander sleeve 510 is disposed inside the hanger 530 in the set position. The expander sleeve 510 remains inside the hanger 530 after the expansion operation is complete. As such, the expander sleeve 510 is configured to support the hanger 530 after the expansion operation.

As shown in FIG. 17, the hanger 530 is urged into contact with the casing 80 to form a fluid-tight seal which is formed in part by a metal-to-elastomer seal and a metal-to-metal contact. More specifically, the seal ring 535 moves into contact with the casing 80 to create a seal between the hanger 530 and the casing 80. As the seal ring 535 contacts the casing 80, the seal ring 535 changes configuration and occupies a portion of the volume gap 545. In the embodiment shown, the volume gap 545 is located on the side of the seal assembly 550 which is the first portion to be expanded by the expander sleeve 510. The location of the volume gap 545 in the seal assembly 550 allows the seal ring 535 to change position (or reconfigure) within the gland 540 during the expansion operation. Additionally, the seal bands 555, 560 in the seal ring 535 are urged toward an interface between the seal assembly 550 and the casing 80 to block the elastomeric material of the seal ring 535 from flowing through the interface 585 between the seal assembly 550 and the casing 80. In one embodiment, the seal bands 555, 560 are springs, such as toroidal coil springs, which expand radially outward due to the expansion of the hanger 530. As the spring expands radially outward during the expansion operation, the coils of spring act as a barrier to the flow of the elastomeric material of the seal ring 535. In addition, after expansion of the hanger 530, the seal bands 555, 560 may prevent extrusion of the seal ring 535 when the gap between the hanger assembly 500 and the casing 80 is increased due to pressure. In other words, the seal bands 155, 160 bridge the gap, and the net extrusion gap between coils of the seal bands 155, 160 grows considerably less as compared to an annular gap that is formed when a seal ring does not include the seal bands. In this manner, the seal bands 555, 560 in the seal ring 535 act as an anti-extrusion device or an extrusion barrier during the expansion operation and after the expansion operation.

Figure 18:
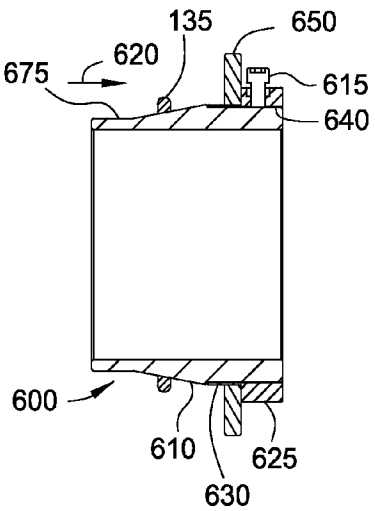
FIG. 18 illustrates a view of an installation tool used during a dry seal stretch operation.

FIG. 18 illustrates a view of an installation tool 600 for use in a dry seal stretch operation. The seal ring 135 is installed in the gland 140 during the fabrication process of the hanger 100 by the dry seal stretch operation. The installation tool 600 generally includes a taper tool 675, a loading tool 625 and a push plate 650. A low-friction coating may be used in the dry seal stretch operation to reduce the friction between the seal ring 135 and the components of the installation tool 600. In one embodiment, the low-friction coating may be applied to a portion of a taper 610 of the taper tool 675 and a portion of a lip 630 on the loading tool 625. In another embodiment, the low-friction coating may be applied to a portion of the seal ring 135. The low-friction coating may be a dry lubricant, such as Impregion or Teflon®.

As shown in FIG. 18, the seal ring 135 is moved up the taper 610 of the taper tool 675 in the direction indicated by arrow 620. The taper tool 675 is configured to change the seal ring 135 from a first configuration having a first inner diameter to a second configuration having a second larger inner diameter (e.g., stretch the seal ring). As illustrated, the loading tool 625 is positioned on a reduced diameter portion 640 of the taper tool 675 such that the lip 630 can receive the seal ring 135. The loading tool 625 is secured to the taper tool 675 by a plurality of connection members 615, such as screws. After the seal ring is in the second configuration, the seal ring 135 is moved to the lip 630 of the loading tool 625.

Figure 19:
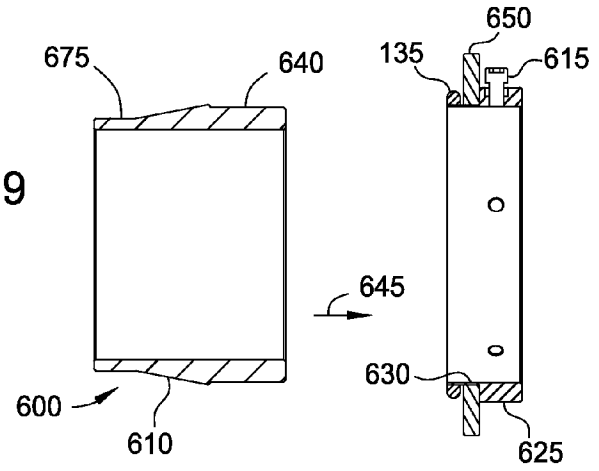
FIG. 19 illustrates a view of a loading tool with the seal ring.
Figure 20:
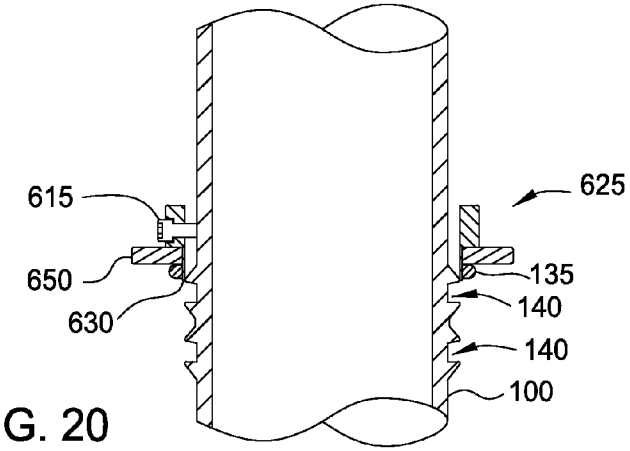
FIG. 20 illustrates a view of the loading tool on the expandable hanger.

FIG. 19 illustrates a view of the loading tool 625 with the seal ring 135. The loading tool 625 and the push plate 650 are removed from the end 615 of the taper tool 600 in the direction indicated by arrow 645. Generally, the loading tool 625 is an annular tool that is configured to receive and hold the seal ring 135 in the second configuration (e.g., large inner diameter). FIG. 20 illustrates a view of the loading tool 625 and the push plate 650 on the expandable hanger 100. The loading tool 625 is positioned on the hanger 100 such that the lip 630 of the loading tool 625 (and seal ring 135) is located adjacent the gland 140. Thereafter, the loading tool 625 is secured to the hanger 100 by the plurality of connection members 615. Prior to placing the seal ring 135 in the gland 140, a bonding material, such as glue, is applied to the selective sides of the gland 140.

Figure 21:
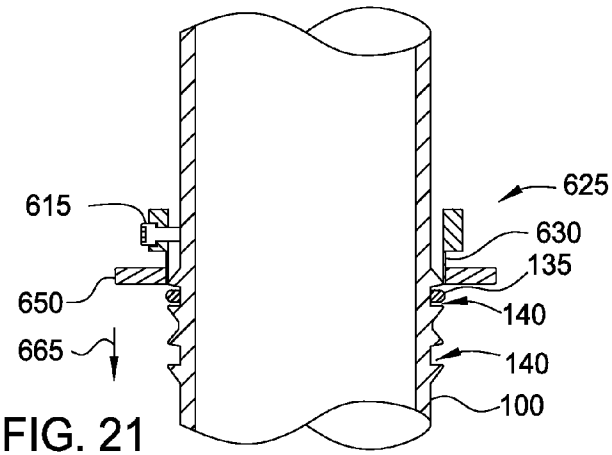
FIG. 21 illustrates a view of a push plate urging the seal ring into a gland of the expandable hanger.

FIG. 21 illustrates a view of the push plate 650 and the loading tool 625. During the dry seal stretch operation, the push plate 650 engages the seal member 135 as the push plate 650 is moved in a direction indicated by arrow 665. The push plate urges the seal ring 135 off the lip 630 of the loading tool 625 and into the gland 140 of the hanger 100. This sequence of steps may be repeated for each seal ring 135.

In one embodiment, a seal assembly for creating a seal between a first tubular and a second tubular is provided. The seal assembly includes an annular member attached to the first tubular, the annular member having a groove formed on an outer surface of the annular member. The seal assembly further includes a seal member disposed in the groove, the seal member having one or more anti-extrusion bands. The seal member is configured to be expandable radially outward into contact with an inner wall of the second tubular by the application of an outwardly directed force supplied to an inner surface of the annular member. Additionally, the seal assembly includes a gap defined between the seal member and a side of the groove.

In one aspect, the gap is configured to close upon expansion of the annular member. In another aspect, the gap is configured to close completely upon expansion of the annular member. In a further aspect, a portion of the seal member is used to close the gap. In an additional aspect, the one or more anti-extrusion bands comprise a first anti-extrusion band and a second anti-extrusion band. In yet a further aspect, the first anti-extrusion member is embedded on a first side of the seal member and the second anti-extrusion band is embedded on a second side of the seal member. In another aspect, the first anti-extrusion band and the second anti-extrusion band are springs. In a further aspect, the first anti-extrusion band and the second anti-extrusion band are configured to move toward a first interface area and a second interface area between the annular member and the second tubular upon expansion of the annular member. In an additional aspect, the first interface area is adjacent a first side of the groove and the second interface area is adjacent a second side of the groove.

In one aspect, the seal member is configured to move into the gap upon expansion of the seal member. In another aspect, a second gap is defined between the seal member and another side of the groove. In a further aspect, a biasing member disposed within the gap. In an additional aspect, a plurality of cutouts formed on an inner surface of the annular member. In another aspect, the annular member is a liner hanger. In yet a further aspect, the annular member is a packer.

In another embodiment, a method of creating a seal between a first tubular and a second tubular is provided. The method includes the step of positioning the first tubular within the second tubular, the first tubular having a annular member with a groove, wherein a seal member with at least one anti-extrusion band is disposed within the groove and wherein a gap is formed between a side of the seal member and a side of the groove. The method further includes the step of expanding the annular member radially outward, which causes the first anti-extrusion band and the second anti-extrusion band to move toward a first interface area and a second interface area between the annular member and the second tubular. The method also includes the step of urging the seal member into contact with an inner wall of the second tubular to create the seal between the first tubular and the second tubular.

In one aspect, the gap is closed between the seal member and the groove upon expansion of the annular member. In another aspect, the gap is closed by filling the gap with a portion of the seal member. In a further aspect, an expander tool is urged into the annular member to expand the annular member radially outward. In an additional aspect, the expander tool is removed from the annular member after the expansion operation. In yet another aspect, the expander tool remains within the annular member after the expansion operation.

In yet another embodiment, a seal assembly for creating a seal between a first tubular and a second tubular is provided. The seal assembly includes an annular member attached to the first tubular, the annular member having a groove formed on an outer surface thereof. The seal assembly further includes a seal member disposed in the groove of the annular member such that a side of the seal member is spaced apart from a side of the groove, the seal member having one or more anti-extrusion bands, wherein the one or more anti-extrusion bands move toward an interface area between the annular member and the second tubular upon expansion of the annular member.

In one aspect, the one or more anti-extrusion bands comprise a first anti-extrusion band and a second anti-extrusion band. In another aspect, the first anti-extrusion band and the second anti-extrusion band are configured to move into an annular gap formed between the annular member and the second tubular after expansion of the annular member due to downhole pressure. In a further aspect, at least one side of the seal member is attached to the groove via glue.

In a further embodiment, a hanger assembly is provided. The hanger assembly includes an expandable annular member having an outer surface and an inner surface. The hanger assembly further includes a seal member disposed in a groove formed in the outer surface of the expandable annular member, the seal member having one or more anti-extrusion spring bands embedded within the seal member. The hanger assembly also includes an expander sleeve having a tapered outer surface and an inner bore. The expander sleeve is movable between a first position in which the expander sleeve is disposed outside of the expandable annular member and a second position in which the expander sleeve is disposed inside of the expandable annular member. The expander sleeve is configured to radially expand the expandable annular member as the expander sleeve moves from the first position to the second position.

In one aspect, a gap formed between a side of the seal member and a side of the groove which is configured to close as the expander sleeve moves from the first position to the second position. In another aspect, a second seal member disposed in a second groove formed in the inner surface of the expandable annular member, the second seal member having one or more anti-extrusion spring bands embedded within the seal member. In another aspect, the second seal member is configured to create a seal with the expander sleeve.

While the foregoing is directed to embodiments of the present invention, other and further embodiments of the invention may be devised without departing from the basic scope thereof, and the scope thereof is determined by the claims that follow.

The invention claimed is:

1. A seal assembly for creating a seal between a first tubular that is disposed within a second tubular, the seal assembly comprising:

an annular member attached to the first tubular, the annular member having a groove formed on an outer surface of the annular member, the groove having a first sidewall, a second sidewall, and bottom surface;

a seal member disposed in the groove, the seal member having:

a bottom surface disposed adjacent the bottom surface of the groove;

a top surface opposite the bottom surface;

a first sidewall disposed adjacent the first sidewall of the groove;

a second sidewall disposed adjacent the second sidewall of the groove; and one or more anti-extrusion bands, wherein the seal member is configured to be expandable radially outward into contact with an inner wall of the second tubular by the application of an outwardly directed force supplied to an inner surface of the annular member; and a gap defined between the first sidewall of the seal member and the first sidewall of the groove, wherein the gap is configured to close upon expansion of the annular member in response to engagement of the seal member and the annular member with the second tubular.

2. The assembly of claim 1, wherein the gap is configured to close completely upon expansion of the annular member.

3. The assembly of claim 1, wherein the one or more anti-extrusion bands comprise a first anti-extrusion band and a second anti-extrusion band.

4. The assembly of claim 3, wherein the first anti-extrusion member is embedded on a first side of the seal member and the second anti-extrusion band is embedded on a second side of the seal member.

5. The assembly of claim 3, wherein the first anti-extrusion band and the second anti-extrusion band are springs.

6. The assembly of claim 3, wherein the first anti-extrusion band and the second anti-extrusion band are configured to move toward a first interface area and a second interface area between the annular member and the second tubular upon expansion of the annular member.

7. The assembly of claim 1, wherein the seal member is configured to move into the gap upon expansion of the seal member.

8. The assembly of claim 1, wherein a second gap is defined between the seal member and a second sidewall of the groove.

9. The assembly of claim 1, further comprising a biasing member disposed within the gap.

10. The assembly of claim 1, further comprising a plurality of cutouts formed on an inner surface of the annular member.

11. The assembly of claim 1, wherein the annular member is a liner hanger.

12. The assembly of claim 1, wherein the annular member is a packer.

13. The assembly of claim 1, wherein at least one side of the seal member is attached to the groove via glue.

14. The seal assembly of claim 1, further comprising an expander sleeve having a tapered outer surface and an inner bore, the expander sleeve movable between a first position in which the expander sleeve is disposed outside of the expandable annular member and a second position in which the expander sleeve is disposed inside of the expandable annular member, wherein the expander sleeve is configured to radially expand the expandable annular member as the expander sleeve moves from the first position to the second position member, and wherein expansion of the annular member is configured to close the gap located between the first sidewall of the seal member and the first sidewall of the groove.

15. The seal assembly of claim 14, further comprising a second seal member disposed in a second groove formed in the inner surface of the expandable annular member, the second seal member having one or more anti-extrusion spring bands embedded within the seal member.

16. The seal assembly of claim 15, wherein the second seal member is configured to create a seal with the expander sleeve.

17. The seal assembly of claim 1, wherein the first sidewall of the groove is disposed at a first angle prior to expansion of the annular member, and a second angle different than the first angle after expansion of the annular member.

18. The seal assembly of claim 14, wherein the first sidewall of the groove is disposed at a first angle prior to expansion of the annular member, and a second angle different than the first angle after expansion of the annular member.

19. A seal assembly for creating a seal between a first tubular that is disposed within a second tubular, the seal assembly comprising:

an annular member attached to the first tubular, the annular member having a groove formed on an outer surface of the annular member, the groove having a first sidewall, a second sidewall, and bottom surface;

a seal member disposed in the groove, the seal member having a bottom surface disposed adjacent the bottom surface of the groove, a top surface opposite the bottom surface, a first sidewall disposed adjacent the first sidewall of the groove, and a second sidewall disposed adjacent the second sidewall of the groove, wherein the seal member is configured to be expandable radially outward into contact with an inner wall of the second tubular by the application of an outwardly directed force supplied to an inner surface of the annular member, and wherein the top surface of the seal member extends radially outward beyond the outer surface of the annular member adjacent the first sidewall of the groove and the second sidewall of the groove in an unexpanded configuration; and a gap defined between the first sidewall of the seal member and the first sidewall of the groove, wherein the gap is configured to close upon expansion of the annular member in response to engagement of the top surface of the seal member and the annular member with the second tubular.

20. The seal assembly of claim 1, wherein the top surface of the seal member is rounded.

21. The seal assembly of claim 1, wherein the groove is defined by a gland having a raised surfaces extending from the outer surface of the annular member.

22. The seal assembly of claim 1, wherein the seal member comprises two raised features on the top surface of the seal member.

23. The seal assembly of claim 15, wherein a gap is formed between a sidewall of the second seal member and a sidewall of the second groove, and wherein the gap is configured to close upon expansion of the annular member.

24. The seal assembly of claim 19, wherein the seal member comprises two raised features on the top surface of the seal member.

* * * * *